United States Patent [19]

Ueda

[11] Patent Number: 4,765,012

[45] Date of Patent: Aug. 23, 1988

[54] MANUALLY OPERATED CLEANER

[75] Inventor: Muneyuki Ueda, Nishinomiya, Japan

[73] Assignee: Nippon Seal Co., Ltd., Osaka, Japan

[21] Appl. No.: 19,805

[22] Filed: Feb. 27, 1987

[30] Foreign Application Priority Data

Mar. 6, 1986 [JP] Japan ..... 61-31997[U]

[51] Int. Cl.[4] ..... A47L 11/33; A47L 11/40

[52] U.S. Cl. ..... 15/4; 15/22 C; 15/27; 15/41 R; 15/47; 15/48; 15/104 A

[58] Field of Search ..... 15/4, 22 C, 27, 47, 15/48, 38, 42, 41 R, 104 A

[56] References Cited

U.S. PATENT DOCUMENTS 3,747,152 7/1973 Tsuruzawa ..... 15/48

3,842,459 10/1974 Tsuruzawa et al. ..... 15/48

FOREIGN PATENT DOCUMENTS 583692 4/1980 Japan .

*Primary Examiner*—Harvey C. Hornsby

*Assistant Examiner*—J. Dwight Poffenberger, Jr.

*Attorney, Agent, or Firm*—Armstrong, Nikaido, Marmelstein & Kubovcik

[57] ABSTRACT

A manually operated cleaner is provided with a body in the form of a box-shaped container having a removable lid and a bottom wall. Two parallel openings are provided through the bottom wall of the container. A roll brush is mounted to project out of one opening and a rotatable semicylindrical brush body is mounted for pivotable movement between two stop members with one of its surfaces including inclined bristles projecting through the other opening. A dust removing brush member having bristles inclined toward the interior of the container is pivotably mounted to the container and urged by spring means to maintain sliding contact with the bristles on the brush body.

2 Claims, 6 Drawing Sheets

MANUALLY OPERATED CLEANER

This invention relates to a manually operated cleaner used primarily for removing fibrous dust, such as cotton yarn waste, wool yarn waste, cotton particles and hair, sticking to articles having a non-smooth surface to be cleaned, such as pile fabrics including carpets or furniture including reception room sofas and chairs using woven fabrics.

Heretofore, devices of this type have been known, for example, one disclosed in Japanese Patent Publication No. 3692/1983. In that device, a roll brush having relatively long bristles set densely therein is disposed in the middle of the lower side of the body of the device. Part of the bottom plate of at least one of dust collecting chambers disposed longitudinally of said roll brush is formed with a rectangular opening, out of which is exposed a part of a brush body having an arcuate peripheral surface and turnably held on opposite lateral walls of the dust collecting chamber. In this brush body, one or both longitudinal sides of a contact element disposed widthwise in an intermediate portion of the peripheral lateral surface are provided with a group of inclined piles or bristles leaned inwardly of the dust collecting chamber. On the inner wall surface of the dust collecting chamber which will come in slide contact with the inclined piles or bristles on the brush body when the brush body is turned back and forth, there is a fixed brush member having another group of inclined piles or bristles leaned in the same direction as the inclined piles on the turnable brush body. It is so arranged that fibrous dust including yarn waste and hair scratched or scraped off by the inclined bristles or piles is removed into the dust collecting chambers.

With the conventional cleaner described above, the lateral peripheral surface of the turnable brush body held on opposite lateral walls of the dust collecting chamber and the fixed brush member formed on the inner wall surface of the dust collecting chamber are maintained spaced a fixed distance from each other. Thus, if either of the groups of inclined piles or bristles fixedly set on said brush body and brush member wear, the contact between the front ends of the inclined piles in the two groups become insufficient. As a result, the fibrous dust scratched or scraped off from the surface to be cleaned by the group of inclined piles on the turnable brush body can hardly be removed by the group of inclined piles on the fixed brush member or cannot be smoothly transferred to the dust collecting chamber.

Further, if a certain size of mass of non-fibrous dust is caught in the clearance between the end edges of the rotatable brush body and fixed brush member, the brush body is thereby prevented from rotating, the scratching-off or scraping off of fibrous dust by the group of inclined piles of the floating brush body does not take place nor does the transfer of removed dust due to the dust collecting chamber by cooperation between the brush body and the fixed brush member until said mass of dust caught in said clearance is removed.

To solve the problems described above, this invention provides a manually operated cleaner comprising a body case composed of a vertically separable box-shaped container and a lid removably mounted on the upper end opening in said container, two parallel quadrangular openings in the bottom wall of said container, a roll brush having a pair of drive wheels driven due to friction against the surface to be cleaned, said roll brush being rotatably held on the inner lateral walls of said container so that said roll brush is received in one of said openings with a part of said roll brush exposing and projecting out of said opening, dust collecting chambers separated by a required number of partition plates and arranged longitudinally along the roll brush in the container, a rotatable brush body provided with one or more stops arranged widthwise in an intermediate portion of its semicircular peripheral lateral surface received in the other opening, said brush body having inclined piles or bristles leaned inwardly of the container at least in one of the regions of the peripheral lateral surface divided by the stops, said brush body being turnably held on the inner lateral walls of the container with a part of said brush body being exposed out of the opening so as to be able to engage with the surface to be cleaned, half-cylindrical dust collecting chambers defined inside the brush body, a dust removing brush member having dust removing piles or bristles leaned or inclind in the same direction as the inclined bristles or piles on the brush body in a portion thereof capable of slide contact with the inclined piles on the brush body when said brush body is rotated (or swung) back and forth, said dust removing brush member being turnably held on the inner lateral walls of said container, spring urging means provided on said dust removing brush member for urging the inclined piles on said member toward said brush body.

With the cleaner as constructed in the manner described above, even if the inclined piles or bristles of either the brush body or the dust removing brush member become short in length because of wear, or any other reason, the inclined piles on the dust removing brush member are always pressed toward the brush body, with the result that the fibrous dust scratched off (or scraped) from the surface to be cleaned by the brush body continues to be subjected not only to the dust removing action but also to the action of being transferred into the dust collecting chambers by the inclined piles on the dust removing brush member.

Further, even if a certain size of mass of non-fibrous hard dust is incidentally caught in the clearance between the brush body and the dust removing brush member, the rotation of the dust removing brush member in the direction to widen the clearance between the brush body and the dust removing brush member (due to the spring urging means) ensures that the mass of dust caught in said clearance is automatically moved to the dust collecting chamber by the repetitive turning action of the brush body.

The invention will be further explained by referring to the accompanying drawings wherein.

Figure 1:
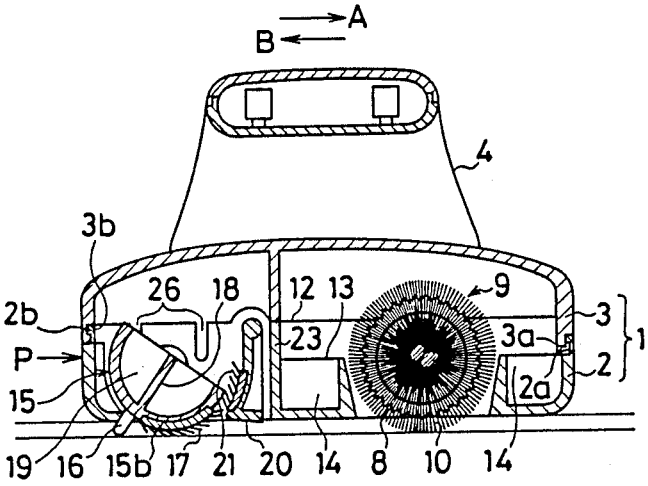
FIG. 1 is a front view, in longitudinal section, of an embodiment of this invention.
Figure 3:
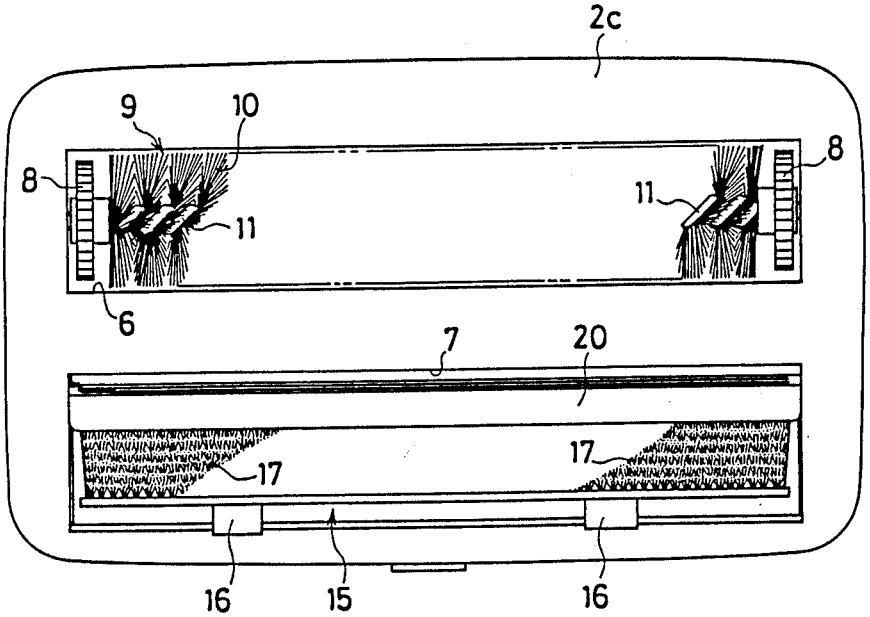
FIG. 3 is a bottom view.
Figure 2:
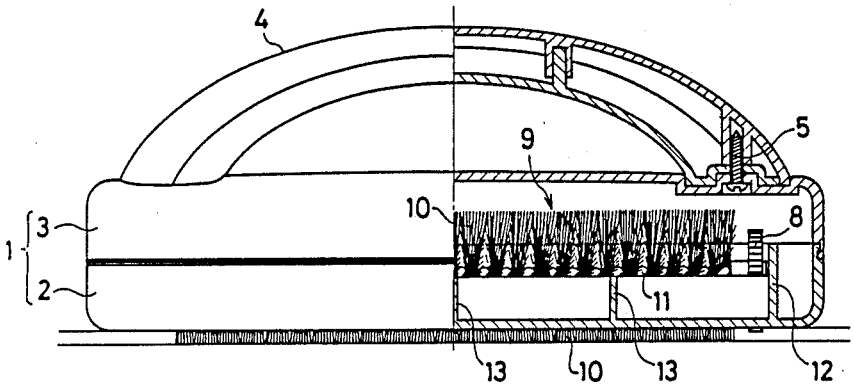
FIG. 2 is a side view, the right half in the longitudinal direction being shown in section.
Figure 4:
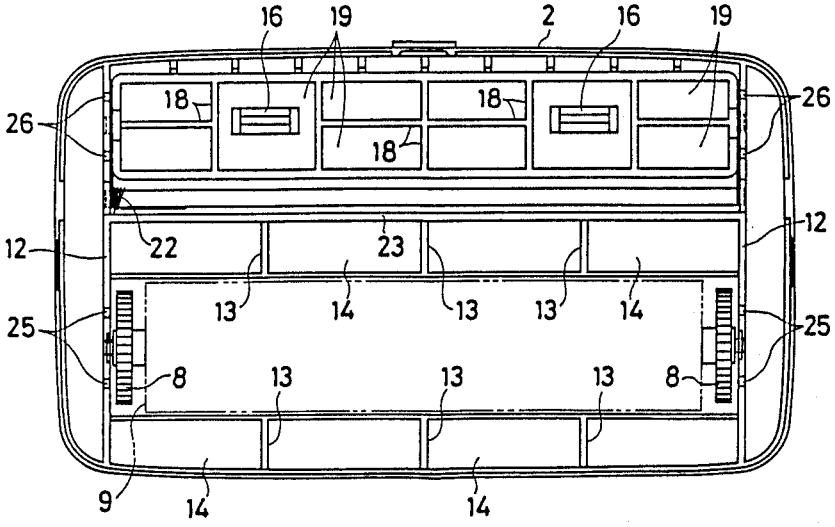
FIG. 4 is a plan view shown with the lid removed.
Figure 5:
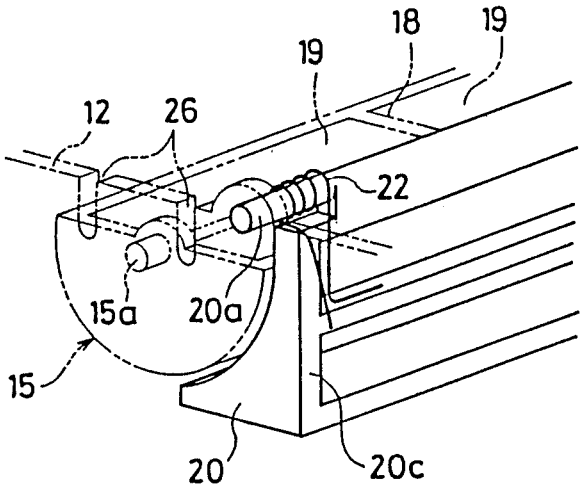
FIG. 5 is a perspective view showing how an urging means is attached to a dust removing brush member.
Figure 6:
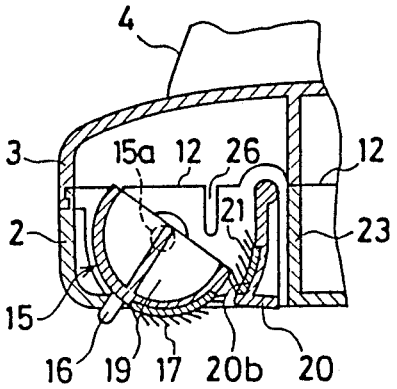
FIGS. 6 through 9 are principal sectional views showing the dust removing action attained by cooperation between the brush body and the dust removing brush member.

In FIGS. 1 and 2, a body case 1 of plastic material is composed of a top-opened box-shaped container 2 and a cover or lid 3 adapted to be elastically fitted to the top opening of the container. The lid 3, as shown in FIG. 1, has a fixed length of portion in a right middle region extending downward along the inner wall surface of the top opening of the container 2, and an outward ridge 3*a* formed on the lower end thereof is adapted to engage with a recess 2*a* formed in the corresponding portion of the container 2, thus providing a fulcrum for the turning movement of the lid 3. The side wall of the container 2 opposite to the recess 2*a* is formed with an engagement ridge 2*b* extending upward along the inner wall surface of the lid 3 for engagement with a locking groove 3*b* formed in the inner wall surface of the lid 3, thereby preventing separation of the lid 3 fitted to the container 2. The middle of the upper surface of the lid 3 has a longitudinally extending, operating handle 4 attached thereto by screws 5.

Therefore, when it is desired to join the lid 3 to the container 2, the user grips the operating handle by hand, holds the lid 3 obliquely with respect to the container 2, engages the ridge 3*a* of the lid 3 with the recess 2*a* of the container 2, and turns the lid 3 with the engaged region serving as the fulcrum until the lid 3 closes the top opening in the container 2. Subsequently, he lightly pushes in the direction of arrow P the portion of the container 2 just below the engagement ridge 2*b* of the container 2 while moving the lid 3 downward and then he stops pushing, whereupon the engagement groove 3*b* is engaged by the engagement ridge 2*b* of the container 2; in this manner the lid is joined to the container 2. On the other hand, the separation of the lid 3 joined to the container 2 can be effected by lightly pushing in the direction of arrow P the portion of the container 2 just below the engagement ridge 2*b* to thereby deform the container 2 of plastic material to disengage the engagement ridge 2*b* from the locking groove 3*b*, gripping the operating handle 4 and somewhat rotating the lid 3 around the fulcrum where the recess 2*a* and ridge 3*a* engage each other, whereupon the lid 3 is separated from the container 2.

The bottom wall 2*c* of the container 2 is formed with two longitudinally extending parallel rectangular openings 6 and 7. One of these openings 6 and 7, for example the opening 6 has a roll brush 9 received therein, said roll brush 9 having a pair of drive wheels 8 on its opposite ends adapted to be turned by friction against the surface to be cleaned when the body case 1 is lightly depressed against the surface to be cleaned by gripping the operating handle 4, said roll brush 9 being rotatably held on the inner lateral walls 12 of the container 2 in such a manner that part of said roll brush 9 is exposed out of the opening 6 so as to engage with the surface to be cleaned. The roll brush 9 is formed with radially extending relatively long bristles 10 centrally clamped by a wire 11.

Arranged longitudinally along the roll brush 9 in the container 2 are dust collecting chambers 14 separated from each other by, for example, three partition plates 13 on each side. These partition plates 13 serve to prevent dust centrifugally collected in the dust collecting chambers 14 from deviating to one side and running out of the dust collecting chambers 14 into the outside of the container 2 in a short time. Thus, the number of partition plates is not limited to three, and any required number of them may be provided.

At the other opening 7 there is a rotatable arcuate or semicylindrical brush body 15 received therein which has two stops 16 in a widthwise intermediate region of its semicircular peripheral lateral surface, said brush body 15 is turnably held at its opposite pivot shafts 15*a* by the inner lateral walls 12 of the container 2 with a part of said brush body 15 being exposed out of the opening 7 so as to be able to engage with the surface to be cleaned. The brush body 15 has a shallow concave surface or recess 15*b* in that region of the peripheral lateral surface divided by the stops 16 which is nearer to the roll brush 9, on which concave surface 15*b* a brush cloth having numerous inclined bristles or piles 17 leaned inwardly of the container 2 (or toward the roll brush) is fixed properly such as by an adhesive agent. Formed in the interior of the brush body 15 are half-cylindrical or ¼-cylindrical dust collecting chambers 19 separated from each other by a plurality of radial or longitudinal partition plates 18. The main purpose of these partition plates 18 is to reinforce the brush body 15. Therefore if its strength is sufficient, the radial or longitudinal partition plates may be omitted. In that case, the dust collecting chamber 19 will be in a half-cylindrical shape.

On the side with which the inclined piles or bristles 17 are brought into slide contact when the brush body 15 is rotated back and forth around the axes of the pivot shafts 15*a*, a dust removing brush member 20 is turnably supported at its pair of pivot shafts 20*a* on its upper end by the inner lateral walls 12 of the container 2. The dust removing brush member 20 has a shallow concave surface or recess 20*b* formed on its arcuate curved surface opposed to the inclined piles 17 on the turnable brush body 15, on which concave surface a cloth having numerous inclined bristles or piles 21 leaned in the same direction as the inclined piles 17 on the brush body 15 is fixed by a suitable manner such as by the use of an adhesive agent. The dust removing inclined piles 21 are held in a position where the piles 21 are capable of keeping slide contact with the inclined piles 17 by a scissors-type spring 22 which is wound on the pivot shaft 20*a* of the dust removing brush member 20 to urge the dust removing brush member 20 toward the brush body 15.

Figure 12:
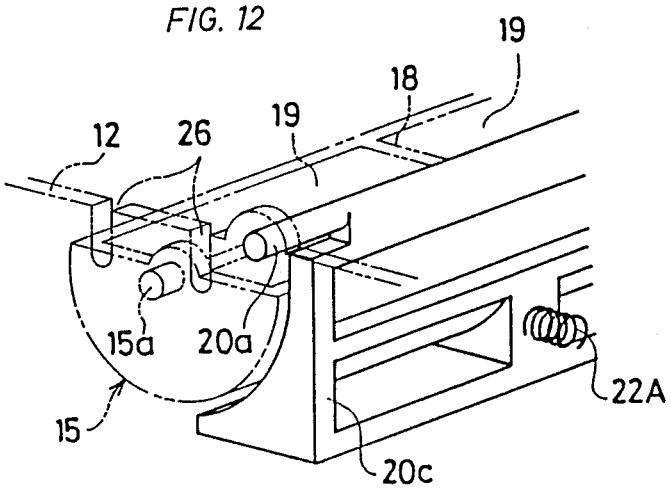
FIGS. 12 and 13 are perspective views showing different forms of urging means.
Figure 13:
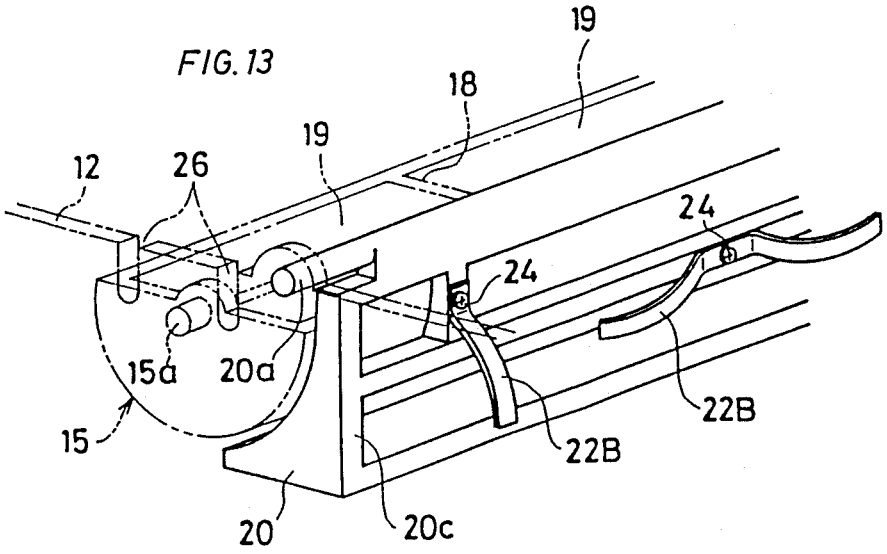

The scissors-type spring 22 serving as the means for urging the dust removing brush member 20 toward the brush body 15 may be replaced by a coiled spring 22A (as shown in FIG. 12) mounted between the back surface 20*c* of the dust removing brush member 20 and a partition plate 23 formed on the container 2 lengthwise of the latter or by sheet spring(s) 22B, as shown in FIG. 13, fixed to the back surface 20*c* of the dust removing brush member 20 longitudinally or horizontally of the latter.

The attaching regions of the inner lateral walls 12 on opposite sides where the roll brush 9 and the brush body 15 are attached are provided with pairs of notches 25 and 26, respectively, for facilitating the mounting and dismounting of the roll brush 9 and floating brush body 15 onto and from the inner lateral walls 12.

The operation will now be described.

Figure 7:
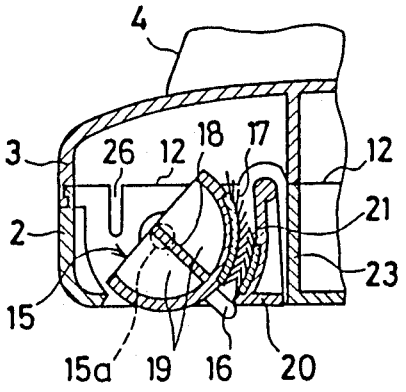

When the body case 1 is moved to the right as indicated by the arrow A (FIG. 1) by the user gripping the operating handle 4, the roll brush 9 in contact with the surface to be cleaned of a carpet of the like such as pile woven fabric for interior decoration is rotated clockwise by the drive wheels 8 and kicks up relatively coarse dust on the pile surface of the carpet or the like obliquely to the upper left by means of the bristles 10 on the roll brush 9, said dust then being received by or arrested in the left-hand dust collecting chamber 14 of the container 2.

on the other hand, the brush body 15 provided at the left-hand opening 7 has its peripheral lateral surface subjected to the frictional force from the surface to be cleaned, which force opposes the movement of the body case 1, so that the inclined piles 17 are withdrawn until the stops 16 are blocked by the end edge of the opening 7 (FIGS. 1 and 7). As a result, the fibrous dust, such as yarn waste and hair, left unremoved on the surface to be cleaned as it cannot be picked up by the bristles 10 of the roll brush 9, is swept off or scratched off and taken in and between the numerous fine inclined piles or bristles 17.

When the body case 1 is moved in the opposite direction indicated by the arrow B, the relatively short dust kicked up obliquely to the upper right by the bristles 10 of the roll brush 9 rotated counterclockwise is collected in the right-hand dust collecting chambers 14 in the container 2. On the other hand, since the brush body 15 is rotated to the position where the stops 16 are blocked by the opposite end edge of the opening 7, the fibrous dust arrested by the inclined piles or bristles 17 is moved to the position where it is contacted by the dust removing inclined piles 21 on the dust removing brush member 20 leaned in the same direction as the inclined piles or bristles 17 (FIG. 7).

Figure 8:
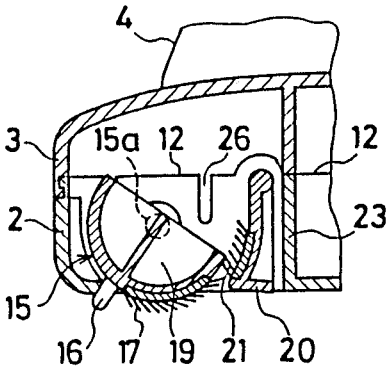

When the body case 1 is moved again in the direction of arrow A, the roll brush 9 performs the same function as it was previously rotated in the same direction, but during the time the brush body 15 is moved from the state shown in FIG. 7 to the state shown in FIG. 8, the fibrous dust arrested by the inclined piles 17 is swept off or scratched off by the dust removing piles or bristles 21 of the dust removing brush member 20 leaned in the direction opposite to the direction of rotation of the brush body 15 and is thereby transferred to the dust removing inclined piles 21. Therefore, the inclined piles 17 now cleaned of dust can act again to arrest fibrous dust on the surface to be cleaned as they did when previously rotated in the same direction.

Figure 9:
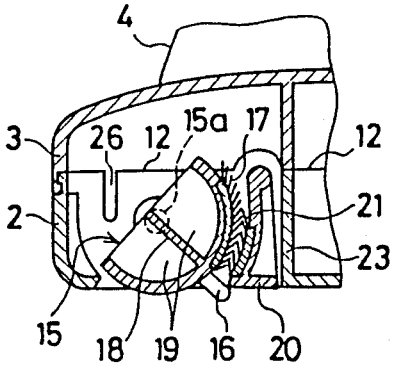

When the body case 1 is moved again in the direction of arrow B, the roll brush 9 performs the same function as it did when previously moved in the same direction B, but the inclined piles 17 arresting fibrous dust and moved inwardly of the container 2 move the fibrous dust retained on the dust removing inclined piles 21 to the innermost region, pushing out said fibrous dust into the dust collecting chambers formed in the brush body 15 (FIG. 9).

When the reciprocating movement described above is repetitively performed, the bristles 10 of the roll brush 9 kick up relatively coarse dust on the surface to be cleaned into the dust collecting chambers 14 each time, while the brush body 15 and dust removing brush member 20 scratch off fibrous dust left on the surface to be cleaned by their respective inclined piles 17 and 21 to retain said fibrous dust in the dust collecting chambers 19.

Figure 10:
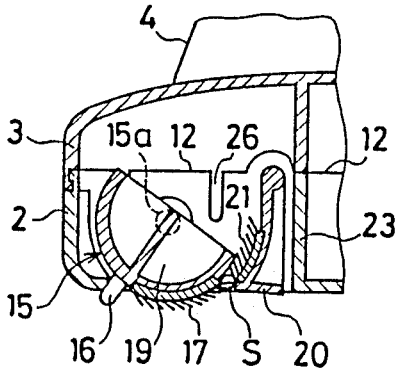
FIGS. 10 and 11 are principal sectional views showing how hard dust caught between the brush body and the dust removing brush member is automatically removed.
Figure 11:
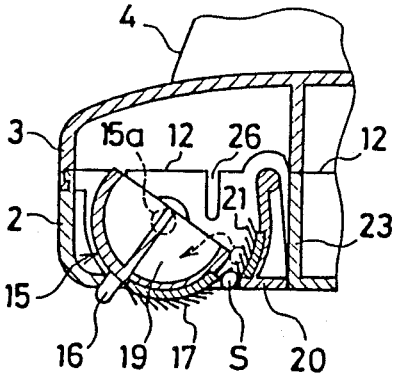

Even if either of the inclined piles 17 and 21 wear during use, the dust collecting brush member 20 is pressed against the brush body 15 by the spring means 22 to maintain tight but slidable contact between the inclined piles 17 and 21; thus, the scratching-off of fibrous dust by the brush body 15 and dust removing brush member 20 and the transfer of fibrous dust scratched off to the dust collecting chambers 19 can be smoothly continued reliably for a long time. Further, even if a large hard non-fibrous dust mass S is caught between the brush body 15 and the dust removing brush member 20 during use, as shown in FIG. 10, the dust removing brush member 20 is rotated counterclockwise against the force of the spring 22 by the dust mass S; therefore, the dust mass S is automatically moved upward along the dust removing brush member 20 by the action of the brush body 15 which is rotating alternately in opposite directions, and the dust mass is then removed and transferred to the dust collecting chamber 19. Thus, the dust removing brush member 20 is pressed against the brush body 15 by the action of the spring 22 again, so that fibrous dust scratched off by the group of inclined piles 17 is removed and transferred to the dust collecting chambers 19.

In addition, in the above embodiment, the group of inclined piles 17 and the dust removing brush member 20 having the group of dust removing inclined piles 21 have been described as installed on one side defined by the stops 16 on the brush body 15. However, they may be intalled on both sides defined by the stops 16; in that case, the scratching-off of fibrous dust and the transfer thereof to the dust collecting chambers 19 can be effected in each stroke of the reciprocating movement of the body case 1.

In a cleaner having a roll brush and a rotatable arcute brush body, according to this invention, a dust removing brush member having dust removing inclined piles tilted in the same direction as the inclined piles on the brush body is urged against the brush body by an urging means. Because of this arrangement, even if either of the inclined piles wears during use, the slide contact between the respective inclined piles can be maintained in satisfactory condition all the time, ensuring that the scratching-off of fibrous dust and the transfer thereof to the dust collecting chambers take place in a stabilized manner for a long time. Further, even if a large hard dust mass is caught between the brush body and the dust removing brush member during use, this dust mass can be automatically removed and transferred to the dust collecting chamber by cooperation between the dust removing brush member urged to rotate in the direction away from the brush body against the action of the urging means and the brush body which is rotated alternately in opposite directions; thus, the original normal state can be automatically restored.

What I claim is:

1. A manually operated cleaner comprising a body case composed of a vertically separable box-shaped container having a bottom wall and a lid removably mounted on an upper end opening of said container, two parallel quadrangular openings in the bottom wall of said container and bounded by inner lateral walls of said container, a roll brush having a pair of drive wheels driven by friction against a surface to be cleaned, said roll brush being rotatably held by said inner lateral walls of said container so that said roll brush is received in one of said openings with a part of said roll brush exposed and projecting out of said opening, dust collecting chambers arranged longitudinally along the roll brush in said container, a rotatable semicylindrical brush body having at least one stop defining a lateral surface region between said stop and a lateral edge of said semicylindrical brush body, said brush body having inclined piles or bristles in said lateral surface region with said piles or bristles inclined toward said lateral edge of said semicylindrical brush body, said brush body being rotatably mounted on said inner lateral walls of said container with a part of said brush body exposed to permit said inclined piles or bristles to project through the other opening so as to engage with said surface to be cleaned, half-cylindrical dust collecting chambers defined inside said brush body, a dust removing brush member having dust removing inclined piles or bristles inclined toward the interior of said container and adapted for sliding contact with said inclined piles on said brush body when said brush body is rotated or swung back and forth, said dust removing brush member being pivotally mounted to said inner lateral walls of said container and spring means between said dust removing brush member and said container for urging said dust removing brush member toward said brush body to maintain said sliding contact between said inclined bristles or piles on said dust removing brush member and said inclined bristles or piles on said brush body.

2. A manually operated cleaner as claimed in claim 1 wherein a handle is provided on the upper surface of said lid.

* * * * *